US006110074A

United States Patent [19]

Tacquet

[11] Patent Number: 6,110,074

[45] Date of Patent: Aug. 29, 2000

[54] FOLDABLE MINI-TRAMPOLINE

[75] Inventor: Maurice-Andre Tacquet, Lexington Pk, Md.

[73] Assignee: Maurice Tacquet, Villeneuve d'Ascq, France

[21] Appl. No.: 08/877,309

[22] Filed: Jun. 17, 1997

[51] Int. Cl.[7] ..... A63B 5/18

[52] U.S. Cl. ..... 482/27; 482/28

[58] Field of Search ..... 482/27, 28

[56] References Cited

U.S. PATENT DOCUMENTS

| | | | |
|---|---|---|---|
| 2,533,520 | 12/1950 | Shimp | 482/27 |
| 4,139,192 | 2/1979 | McNeil | 482/27 |
| 4,381,861 | 5/1983 | Howel, Jr. et al. | 482/27 |
| 4,452,444 | 6/1984 | Schulze, Jr. | 482/27 |
| 5,545,110 | 8/1996 | Hsiang | 482/27 |

*Primary Examiner*—Jerome Donnelly

[57] ABSTRACT

The invention is a mini trampoline on which the frame is made in several parts in order to be easily carried and assembled. The mat is linked to the frame by means of springs and grommets. U shaped covers maintain the frame on one plane level. The tension of the springs is obtained by increasing the size of the frame.

8 Claims, 7 Drawing Sheets

FOLDABLE MINI-TRAMPOLINE

BACKGROUND OF THE INVENTION

1. Field of the Invention

The present invention relates to a mini-trampoline constructed to be readily compacted, easily transported, and to readily adjust mat tension for individuals of varying weight.

2. Description of the Prior Art

The mini-trampolines generally consist of a mat of flexible, resilient webbing secured to a frame by means of a plurality of coil springs. The frame is positioned in a relatively short distance off the ground by a plurality of legs which are attached to the frame. As fully assembled, an individual can perform a variety of aerobic exercises which improve muscles tone, blood and lymph circulation due in part to increased cellular and muscular stress imparted by the variation of gravitational force encountered during exercises.

The mini-trampolines currently available on the market are made of one piece frame, are not foldable and the tension of the frame is not adjustable.

Several solutions have been patented in order to be able to assemble and disassemble a trampoline. But it seems that none of them has been successful on the market for various reasons. It could be because, when folded, the overall dimension is still too large, or because the force applied via springs is so strong that the assembly is too difficult for women or children, or because adjustment of the mat tension is not possible.

Thus, a need exists for a mini-trampoline which can be readily folded, put into a sport bag, carried and assembled by anyone, including a child and which provides for adjustment of mat tension so as to accomodate individuals of varying weight.

SUMMARY OF THE INVENTION

The present invention relates to a foldable and portable mini-trampoline having a sectional frame rail formed of an even number of frame sections, a same number of junction elements and a mat formed of flexible, resilient webbing and secured to the frame by a plurality of coil springs.

When disassembled, the frame sections can be folded and superimposed to a compact position to facilitate transportation.

When assembling the mini-trampoline, junction elements cover the ends of adjacent frame sections.

The frame sections can slide inside the junction elements which hold the frame sections in a same plane.

The specificity of the invention is that each junction element includes a cover and a toggle bolt comprising a screw, a nut and two pushrods. The screw (or the nut) takes support from the cover in order that the nut (or the screw) pushes the pushrods against the ends of the adjacent frame sections. The more the bolts are screwed, the more the distance between the ends of the adjacent frame sections increases. Consequently, the periphery of the whole frame increases as well as it's diameter and it's distance from the mat. The length of the springs which link the mat to the frame is increased and consequently the tension of the springs and the tension of the mat.

In the prefered embodiment, the junction elements include also vertical legs which give support and balance.

At that time the distance between the ends of adjacent frame sections is "X".

Figure 6:
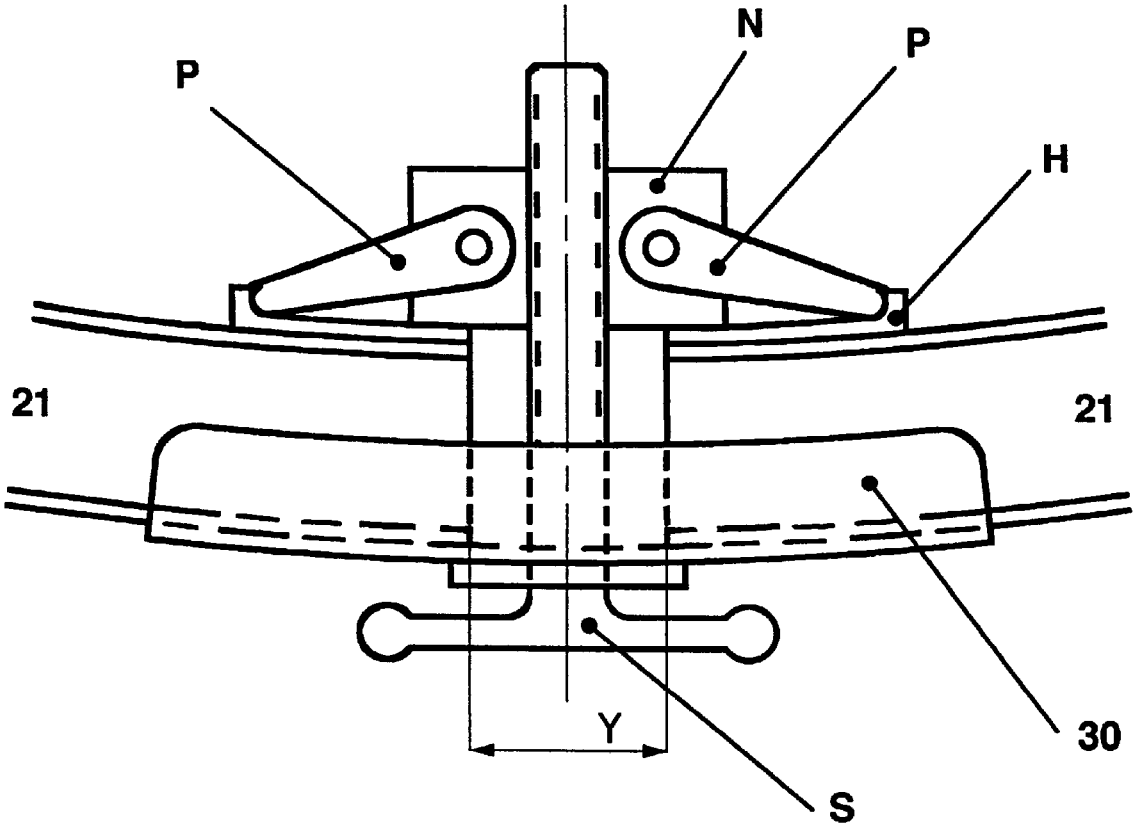

FIG. 6 is a view of a junction element, two ends of frame sections and the toggle bolt when the screw has been fully turned.

At that time the distance between the ends of adjacent frame sections has become "Y".

Figure 7:
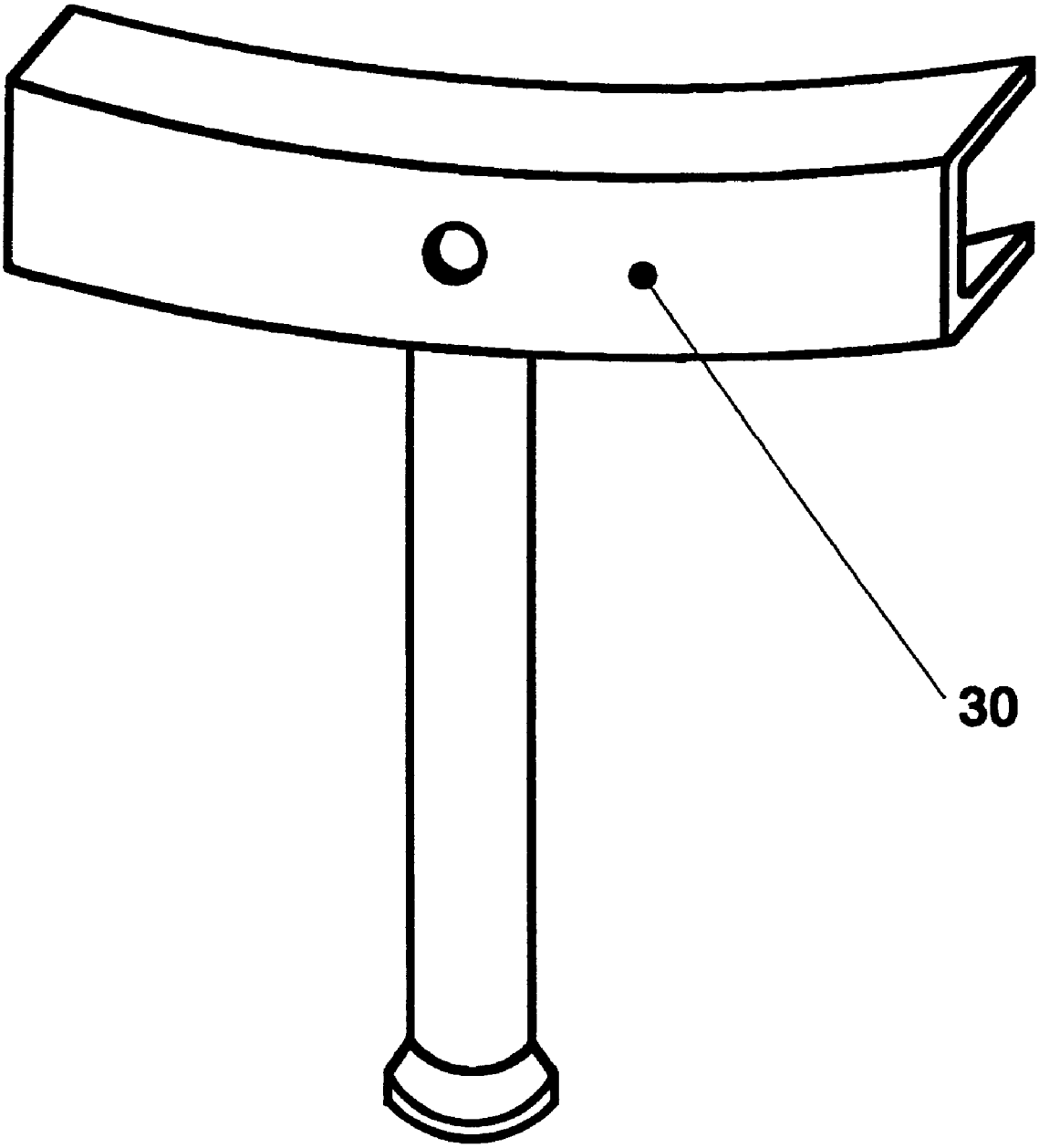

FIG. 7 is a perspective view of a junction element which is also used as a leg.

DESCRIPTION OF THE PREFERED EMBODIMENTS

Figure 1:
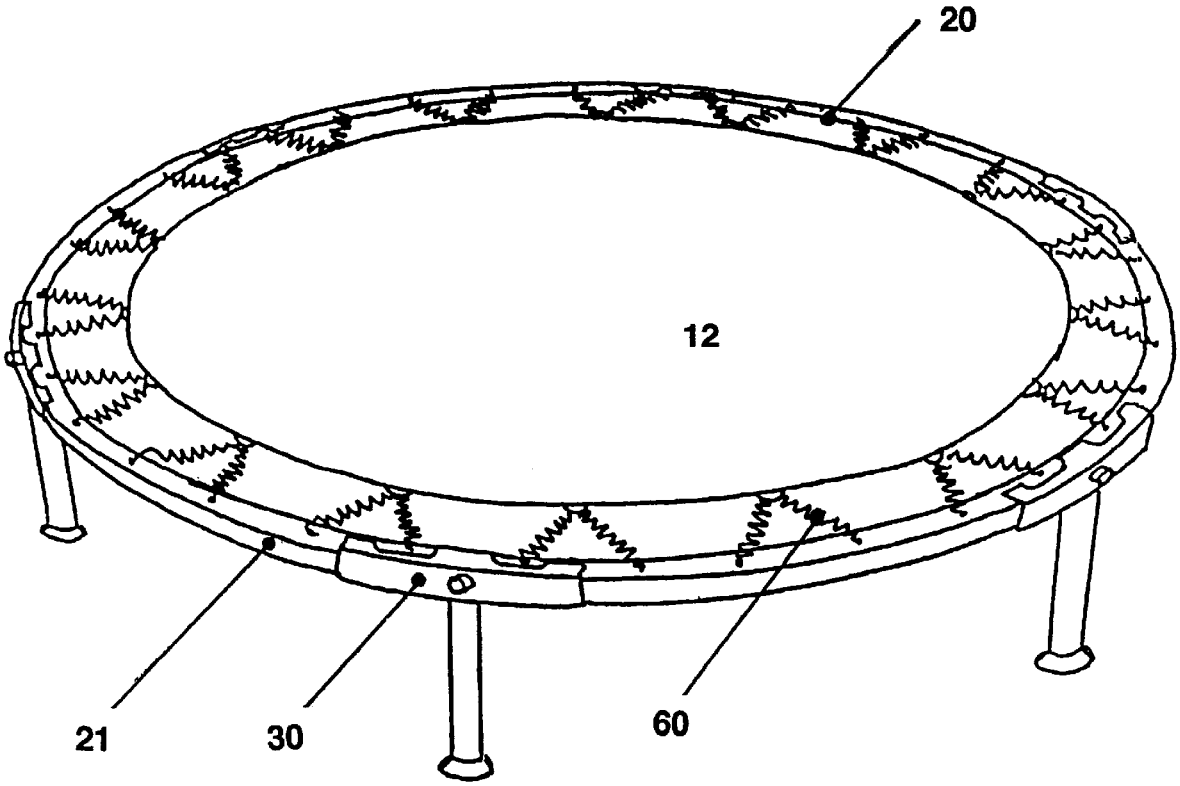
FIG. 1 is a perspective view of the mini-trampoline of the present invention in a fully extended position ready for use.

The rebound exerciser of the present invention called "foldable mini-trampoline", illustrated in FIG. 1, is generally comprised of six identical frame sections 21, a resilient mat 12 which is secured to the whole frame 20 by means of a plurality of coil springs 60 and six junction elements 30 which work also as legs.

In the position shown in FIG. 1, the frame sections cooperate to define a circular frame configuration.

Figure 2:
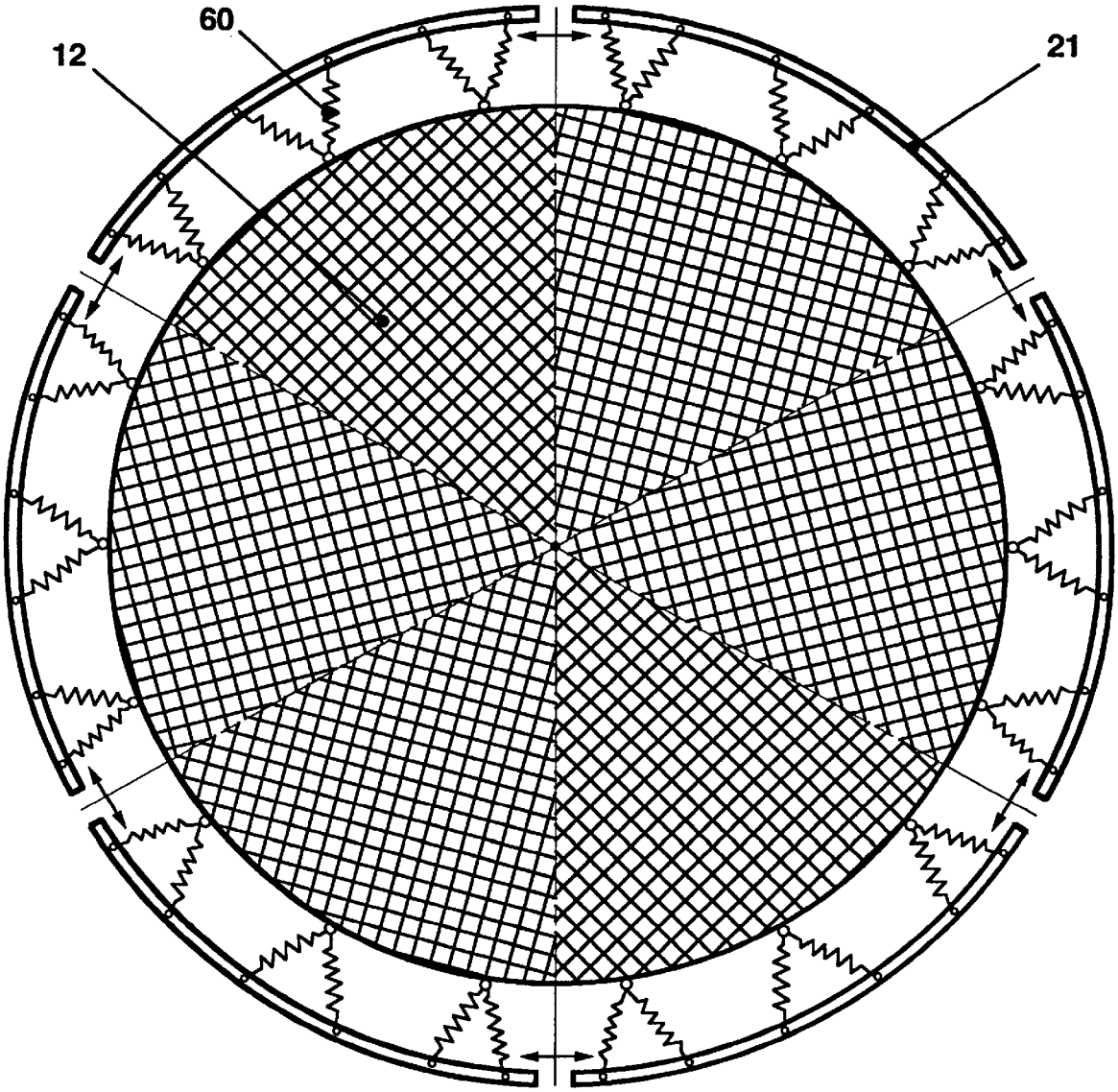
FIG. 2 is a view of the mat, the frame sections and the springs which link the frame to the mat. In that view, the juntion elements have been taken away.

Although a circular peripherical configuration is prefered, it will be understood that any peripherical configuration capable of being formed of frame sections can be utilized in accordance with the present invention. Referring to FIG. 2, when the trampoline is disassembled, the six frame sections 21 are completely independant from each other and the tension of the springs 60 is released, therefore releasing the tension on the mat too.

Although a number of six frame sections is prefered, it will be understood that any even number of frame sections can be utilized in accordance with the present invention.

Figure 3:
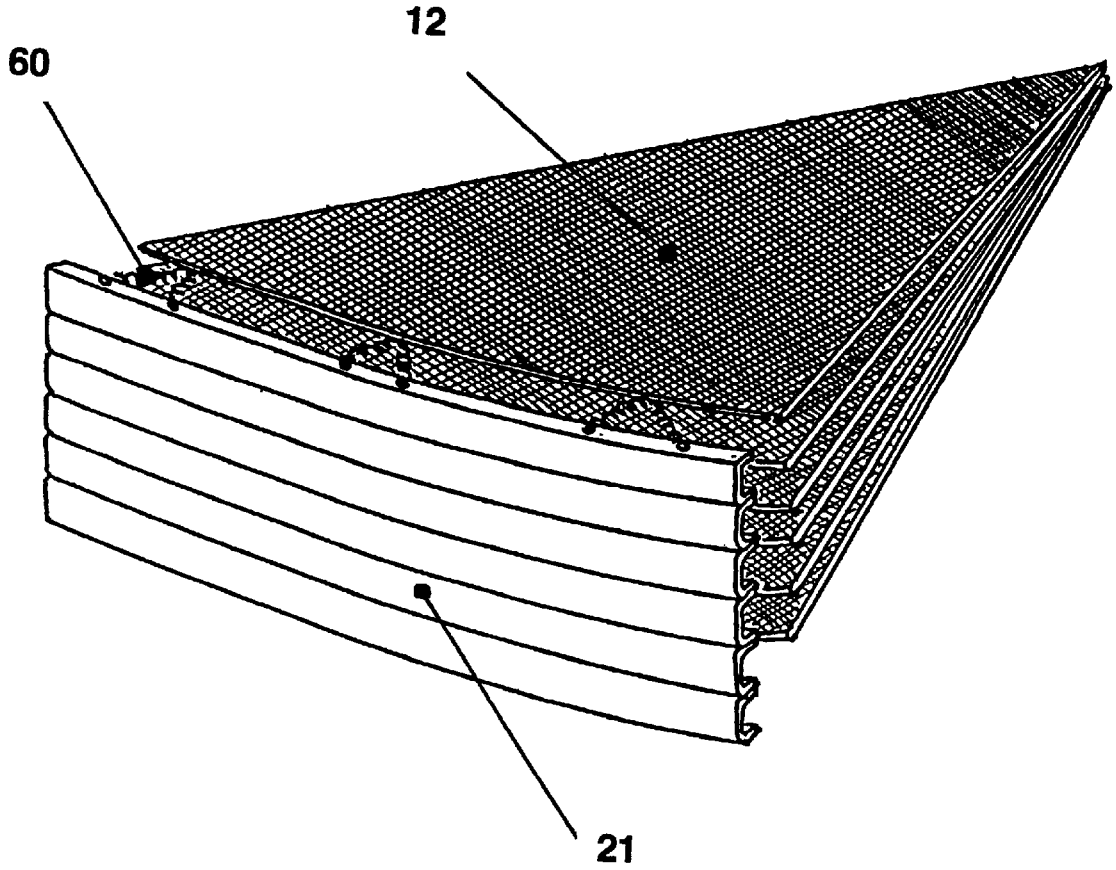
FIG. 3 is a view of the mini-trampoline after the frame sections have been superimposed for transportation.

Referring to FIG. 3, when disassembled, the frame sections 21 can be superimposed and the mat 12 folded in a portable position without the need of removing the mat 12 and springs 60 from the frame sections 21. For example, a mini-trampoline with an external diameter of 1 meter, would have frame sections of approximately 473 mm in length. This length fits perfectly with a standard sport bag of 500 mm in length.

Figure 4:
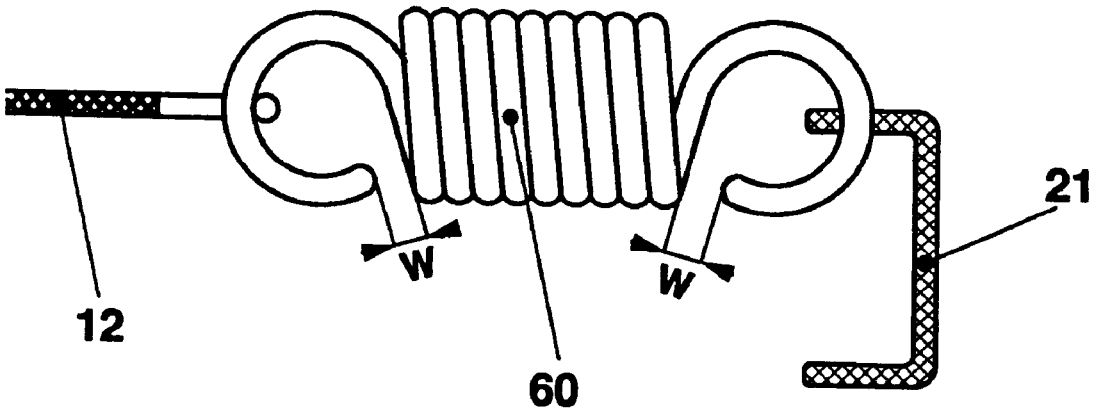
FIG. 4 is a view of an extension coil spring which links the frame to the mat.

Referring to FIG. 4, the extension coil springs 60 are secured on one side to the frame sections 21 via holes and on their other side to the mat 12 via hooks positionned on the edge of the mat at equal distances.

These hooks can be made of steel rods or aluminium rods or plastic pieces attached to the mat in order to apportion the force applied via springs 60 along the edge of mat 12.

As the extension coil springs have an initial tension, they apply that initial tension to the mat as soon as the diameter of the frame is increased at the beginning of the assembly operation. Afterwards, the tension increases proportionnally to the length of the springs.

Figure 5:
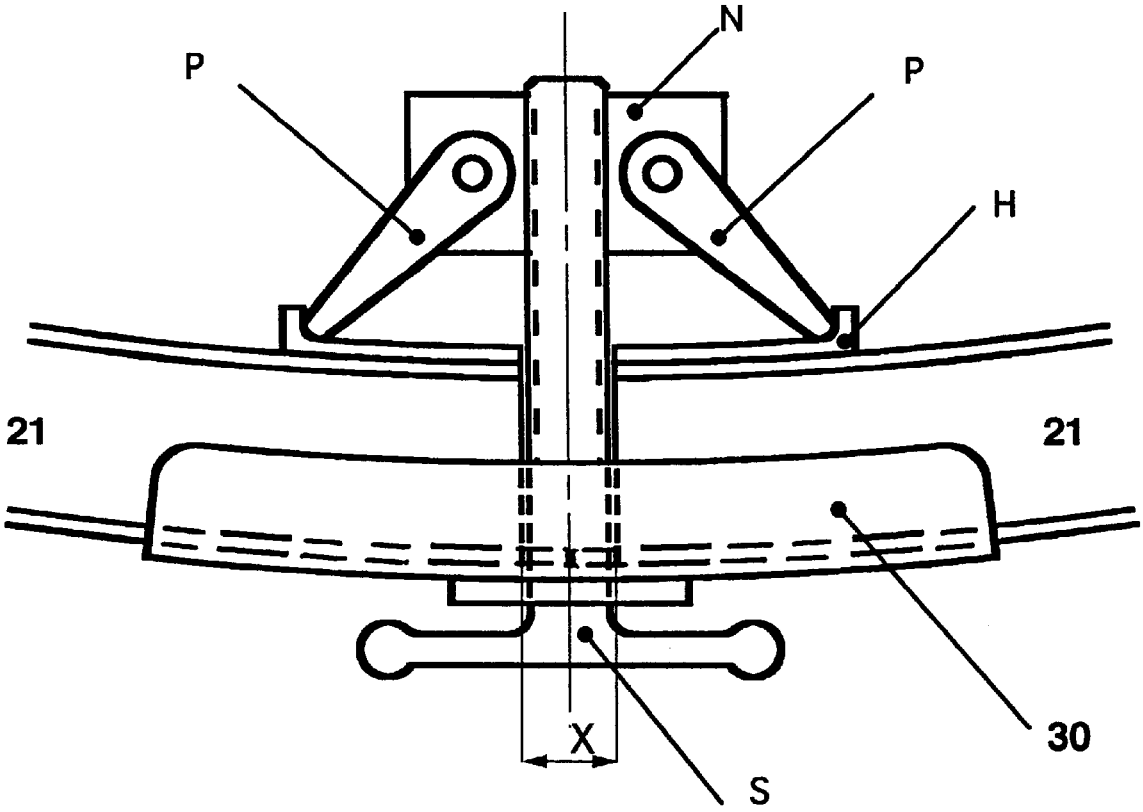
FIG. 5 is a view of a junction element, two ends of frame sections and the toggle bolt at the beginning of the assembly before turning the screw.

The section of the frame shown on FIG. 4, is a channel section, but the shape of the frame could have many other shapes as square, rectangular, oval, round, etc, . . . , The frame sections can be made of various material such as steel, aluminium, wood, plastic, reinforced plastic, etc, . . . , Reffering to FIG. 5 and FIG. 6, it is shown how the mini-trampoline will be assembled and how the tension of the mat will be increased progressively. To prepare the mini-trampoline, the frame elements which were superimposed for transportation will be first laid on the floor as shown on FIG. 2. After that, the junction elements 30 will cover the ends of the adjacent frame sections 21 as shown on FIG. 5. The junction elements are equipped with toggle bolts (parts N, P, S). At that moment, the initial distance between the ends of the adjacent frame sections is "X". There is no tension of the springs 60 nor of the mat 12. In order to have the mini-trampoline ready for use, it is necessary to give tension to the mat. The user will use a crank to turn the screw S and doing that, the pushrods P will push against the thrusts H and the distance between the ends of the adjacent frame sections 21 will be increased. The more the user turns the screw, the more the distance between the ends of the adjacent frame sections increases, and when that distance increases, it also increases the diameter of the whole frame 20 as well as it's distance from the mat. As the mat 12 is linked to the frame 20 by means of the springs 60, the length of the springs is increased and the force applied via springs increases proportionnally to their length. The tension of the mat 12 increases at the same time as the force applied via the springs 60. The maximum tension of the mat 12 is obtained when the screws "S" have been fully turned. At that moment, the distance between the ends of the adjacent frame sections is "Y".

As the tension of the springs 60 is released when the trampoline is disassembled, the opening "W" (FIG. 4) of the loop at the ends of the springs 60 must be small enough to prevent the springs from being detached of the mat or of the frame. Another way to prevent the springs from being detached is to secure the hooks of the springs with some glue (silicone for example).

Referring to FIG. 7, the junction elements 30 can be used as legs too. The inside shape of the junction elements 30 fits with the outside shape of the frame sections 21 in such a way that, when the junction elements 30 cover the ends of the frame sections 21, these frame sections 21 are held in one plane and can slide inside the junction elements 30. This is how the diameter of the frame can be increased and how the tension of the mat is obtained.

What is claimed as new is as follow:

1. A trampoline kit having component parts capable of being assembled at a given site so as to provide a trampoline for use by an individual, the trampoline kit comprising:

a) a frame rail formed by a plurality of frame sections, each of them having abutments at both ends;

b) a mat of flexible, resilient webbing;

c) a plurality of coil springs, each of them having one end secured to the mat and the other end secured to the frame;

d) a plurality of legs;

e) junction elements, each of them having an internal shape which mates with the external shape of said frame sections, thereby providing a sliding assembly and having a hole in the middle of its external side; and f) toggle bolt assemblings, each of them comprising a screw which is engaged through the hole of said junction element into a nut, said nut including at least two push rods which press against said abutments of said adjacent frame sections for increasing the diameter of said frame rail and thereby tightening said coil springs.

2. A trampoline as defined in claim 1 wherein the frame has a sectional circular configuration with six sections and six junction elements.

3. A trampoline as defined in claim 1 wherein the junction elements are also used as legs.

4. A trampoline as defined in claim 1 wherein the shape of the frame sections are of channel shape, square shape, round shape or T shape.

5. A trampoline as defined in claim 1 wherein the frame sections are made of steel, or aluminum alloy, or wood, or plastic, or reinforced plastic.

6. A trampoline as defined in claim 1 wherein the junction elements are made of steel, or aluminum alloy, or wood, or plastic, or reinforced plastic.

7. A trampoline as defined in claim 1 wherein the ends of coil springs are secured to the frame and/or to the mat by means of glue.

8. A trampoline as defined in claim 1 wherein the springs are of compression type with or without initial tension.

* * * * *